US005860868A

United States Patent [19]

Emery, III

[11] Patent Number: 5,860,868

[45] Date of Patent: Jan. 19, 1999

[54] SCORE DISPLAY ASSEMBLY

[76] Inventor: George B Emery, III, 23732 Hillhurst Dr., Apt #38, Laguna Niguel, Calif. 92677

[21] Appl. No.: 912,600

[22] Filed: Aug. 18, 1997

[51] Int. Cl.[6] ..... A63B 57/00

[52] U.S. Cl. ..... 473/1; 116/223; 235/114

[58] Field of Search ..... 248/205.5, 363; 235/114; 473/1; 116/624, 223

[56] References Cited

U.S. PATENT DOCUMENTS

| | | | |
|---|---|---|---|
| 2,996,247 | 8/1961 | Shell | 235/114 |
| 3,169,331 | 2/1965 | Herster | 235/114 |
| 3,455,273 | 7/1969 | Willingham | 235/114 |
| 3,515,092 | 6/1970 | Stengel | 235/114 |
| 4,998,726 | 3/1991 | Budnick | 235/114 |

*Primary Examiner*—Theatrice Brown

[57] ABSTRACT

A score display assembly for pool tables having a front wall and a rear wall that are detachably secured together to form a housing. There are 15 vertically oriented discs rotatably mounted in the housing and their upper perimeter extends through their respective slots in the top of the housing. Each disc has a window in the front wall for identifying indicia on the front surface of the respective discs. A plurality of suction cups are secured to the rear wall of the score display assembly for detachably securing it to the side wall of a pool table immediately above a ball return chamber.

3 Claims, 2 Drawing Sheets

SCORE DISPLAY ASSEMBLY

BACKGROUND OF THE INVENTION

The invention relates to pool tables and more specifically to a score display assembly that is detachably secured to the side wall of a coin-operated pool table.

Conventional pool tables allow a player who has put a particular ball in a pool table pocket to place it on a shelf or rack structure reserved entirely for that player. This allows all of the players to have a clear view as to who has pocketed each of the particular balls.

In a coin-operated pool table, the only ball that can be retrieved from the table after it has gone into a pocket is the cue-ball. The numbered balls are all directed to a ball return chamber that is often visible along one of the side walls of the table. It is thus difficult to remember what balls were pocketed by the pool players unless the players keep track on a chalkboard or pad of paper.

It is an object of the invention to provide a novel score display assembly that can be detachably secured to the side wall of a coin-operated table immediately above the window covering the pool ball return chamber.

It is another object of the invention to provide a novel score display assembly for coin-operated pool tables that is easy to install and remove from a pool table.

It is another object of the invention to provide a novel score display assembly for coin-operated pool tables that is economical to manufacture and market.

It is an additional object of the invention to provide a novel score display assembly for coin-operated pool tables that allows all of the players to easily remember who has pocketed each of the fifteen balls just by looking at the score display assembly.

SUMMARY OF THE INVENTION

The novel score display assembly has been designed to be used with coin-operated pool tables. Its length is greater than 33 inches and it is preferably formed from at least two compartments that are detachably secured to each other adjacent their abutting ends. A plurality of suction cups are secured to the rear wall of the score display assembly for detachably securing it to the side wall of a pool table immediately above the window of the ball return chamber.

The score display assembly has 15 discs having indicia in the form of numbers on their front surface and indicia in the form of numbers on the perimeter surface of the disc. The discs are vertically oriented and pivotally mounted in the score display assembly. A window is formed in the front wall of the score display assembly adjacent each disc. Once a player has pocketed a ball, it travels to the ball return chamber and is directed to a position immediately below one of the discs. One of the players rotates that particular disc to the proper number that identifies the player pocketing the ball. This allows all of the players to merely glance at the score display assembly in order to determine which player made the balls in the ball return chamber.

DESCRIPTION OF THE PREFERRED EMBODIMENT

The novel score display assembly is generally designated numeral 10 and its structure will be described by referring to FIGS. 1–8 of the drawings.

Figure 1:
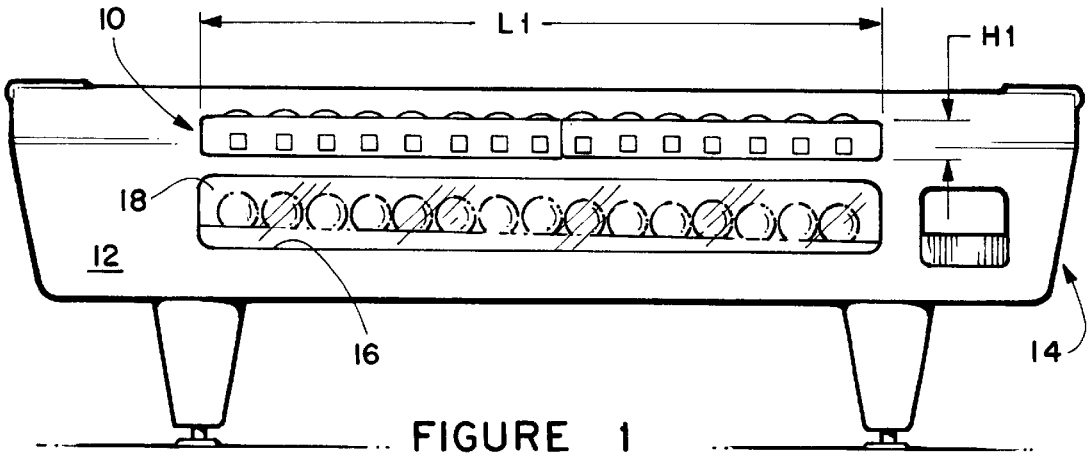
FIG. 1 is a side elevation view illustrating the novel score display assembly mounted on the side of a pool table.

In FIG. 1, score display assembly 10 is illustrated secured to the side wall 12 of a pool table 14. Pool table 14 would be coin operated. It has a ball return chamber 16 formed in side wall 12 that is covered by window 18. All fifteen of the pool balls will be clearly visible and each would align with their respective windows 20 in the score display assembly mounted above.

Figure 7:
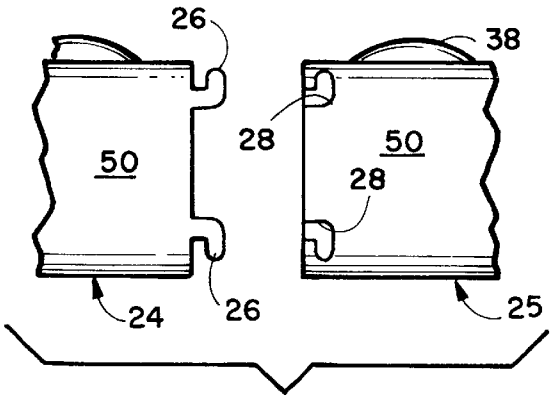
FIG. 7 is an exploded rear elevation partially showing the two compartments of the score display assembly disassembled.

Score display assembly 10 is formed from separate compartments 24 and 25 that are detachably secured together by the structure illustrated in FIG. 7. Compartment 24 has a pair of fingers 26 extending from its one end that are detachably engaged in slots 28 in compartment 25.

Figure 5:
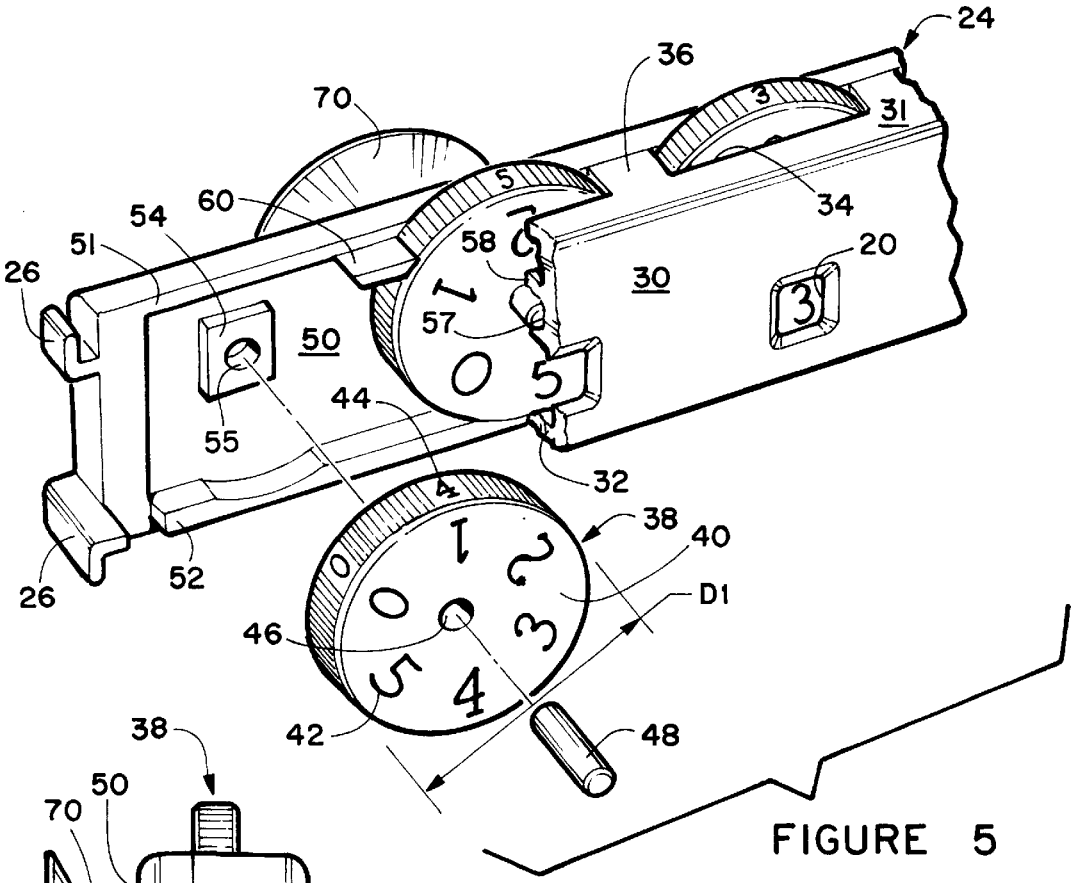
FIG. 5 is a front perspective view of one of the compartments of the score display assembly with portions broken away and also in exploded view.
Figure 6:
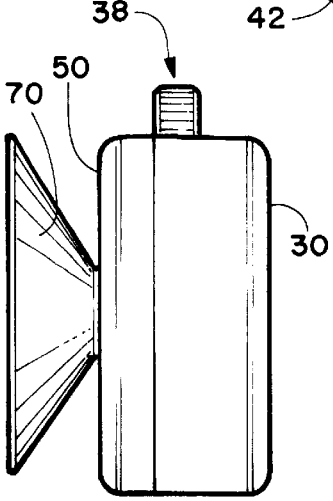
FIG. 6 is an enlarged left end elevation view of the novel score display assembly.
Figure 2:
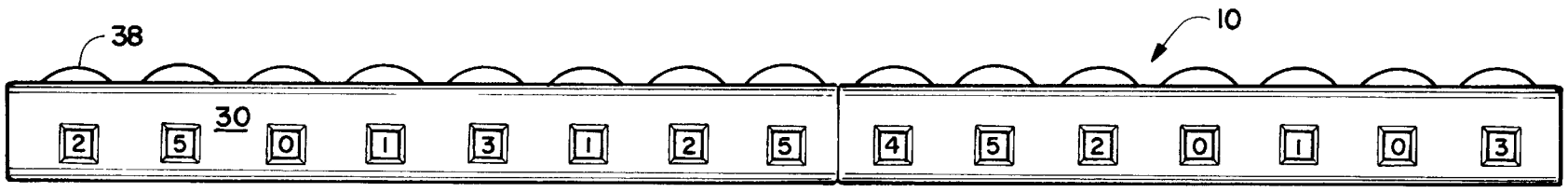
FIG. 2 is a front elevation of the novel score display assembly.
Figure 3:
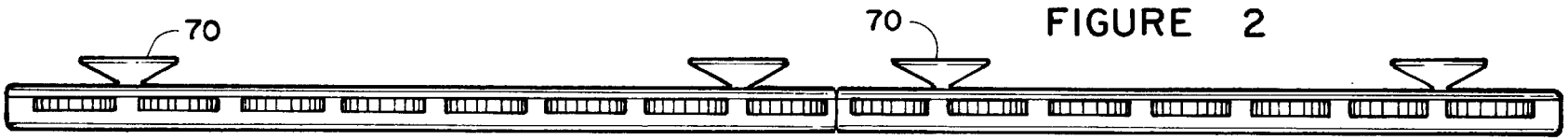
FIG. 3 is a top plan view of the novel score display assembly.
Figure 4:
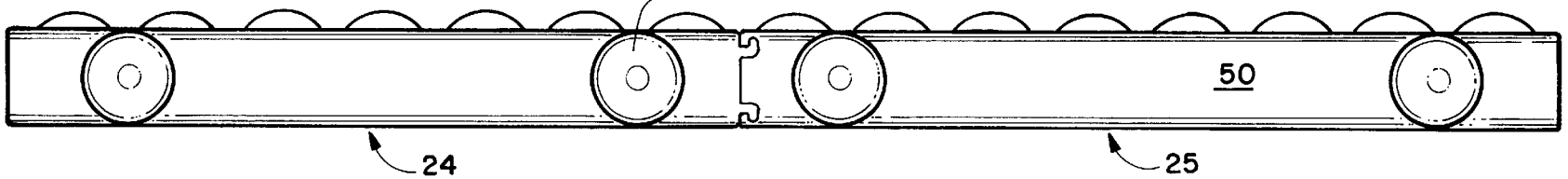
FIG. 4 is a rear elevation view of the novel score display assembly.
Figure 8:
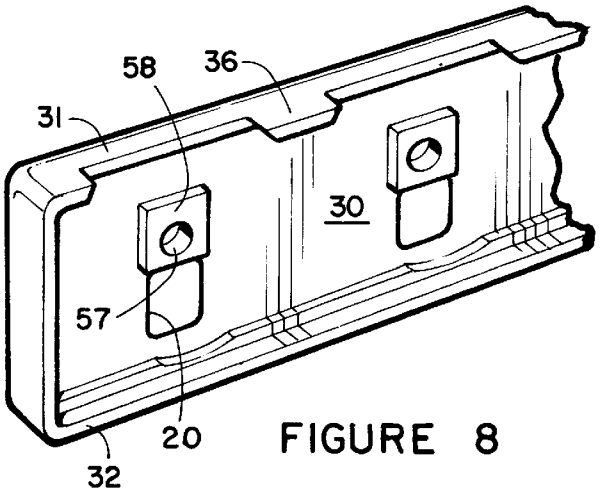
FIG. 8 is a front perspective view of a portion of the rear wall of the score display assembly.

The structure of the individual compartments is best illustrated by viewing FIGS. 5 and 8. Compartment 24 has a front wall 30 having a top flange 31 and a bottom flange 32. A plurality of slots 34 are formed in top flange 31 with fingers 36 formed between the respective slots. Discs 38 have their top perimeter surface extending through one of the respective slots 34. Each disc 38 has a front surface 40 having indicia 42 in the form of numbers spaced around its front surface. Indicia 44 in the form of numbers is also spaced around the outer perimeter of each of the discs 38. A bore hole 46 receives a pin 48 so that it is rotatably mounted and the indicia 42 can be rotated in front of windows 20 to indicate which player has made the ball immediately therebeneath in the ball return chamber 16. Discs 38 have a diameter D1 and D1 is in the range of 1½ inches to 2¼ inches.

Rear wall 50 has a top flange 51 and a bottom flange 52. There are a plurality of protruding boss members 54 on the front inside surface of rear wall 50 and they have a bore hole 55 that receives the rear end of pin 48 and the front end of pin 48 is received in a bore hole 57 of a protruding boss member 58 of the front wall 30. A plurality of fingers 60 telescope beneath fingers 36 of front wall 30 when the two members are secured together.

Score display assembly 10 has a length L1 that is greater than 33 inches. It also has a height H1 that is greater than 1.5 inches. A plurality of suction cups 70 are secured to the rear surface of rear walls 50.

What is claimed is:

1. A score display assembly for pool tables comprising:

at least two separate elongated compartments each having a left end and a right end; said compartments each being at least 16 inches long; interlocking means formed on said right end of one of said compartments and interlocking means formed on said left end of said other compartment for detachably securing said two compartments together to form a single elongated structure;

each of said compartments having an elongated front wall having a rearwardly extending top flange, a rearwardly extending bottom flange, a left end, a right end, an outer surface and an inner surface; at least seven slots are formed in said top flange along its length at predetermined locations and they form rearwardly extending fingers between said respective slots; a plurality of windows are formed in said front wall along its length at predetermined locations and the number of these windows is at least equal to the number of said slots formed in said top flange;

each of said compartments having an elongated rear wall having a top edge, a bottom edge, a left edge, a right edge, a rear outer surface and a front inner surface; said rear wall being secured to said front wall to form a housing for a plurality of discs;

at least one vertically oriented disc for each of said slots in said top flange of said compartments and said discs each having a diameter in the range of 1.5–2.25 inches, a front surface, a rear surface, a central bore hole extending from said front surface to said rear surface and an outer perimeter surface; indicia on said front surface in the form of numbers;

means for rotatably mounting each of said discs in said housing between said front and rear walls so that a portion of their outer perimeter extends through said respective slots and said top flange of said front wall and said indicia on the front surface of said disc is positioned to be visible through the respective windows in said front wall; said disc thus being externally rotatable; and said means for rotatably mounting each of said discs in said housing comprising; a pin journaled in said bore hole of each of said discs; said pins each having a front end and a rear end; said front end of said pins being seated in said bore holes of boss members protruding rearwardly from said inner surface of said front walls; and said rear ends of said pins being seated in said bore holes of boss members protruding forwardly from said front inner surface of said rear walls.

2. A score display assembly as recited in claim 1 wherein said front wall has at least 15 windows and said housing has at least 15 discs.

3. A score display assembly as recited in claim 1 further comprising a plurality of suction cups secured to said rear outer surface of said rear wall.

* * * * *